US009750376B2

(12) United States Patent
Dragovic et al.

(10) Patent No.: US 9,750,376 B2
(45) Date of Patent: Sep. 5, 2017

(54) PORTABLE SPA CONSTRUCTION

(71) Applicant: Watkins Manufacturing Corporation, Vista, CA (US)

(72) Inventors: Zeljko Dragovic, Vista, CA (US); Sam Shifron, Del Mar, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

(21) Appl. No.: 15/263,815

(22) Filed: Sep. 13, 2016

(65) Prior Publication Data

US 2016/0374896 A1 Dec. 29, 2016

Related U.S. Application Data

(62) Division of application No. 14/263,144, filed on Apr. 28, 2014, now Pat. No. 9,572,459.

(60) Provisional application No. 61/927,396, filed on Jan. 14, 2014.

(51) Int. Cl.

| | |
|---|---|
| ***A47K 3/02*** | (2006.01) |
| ***A47K 3/06*** | (2006.01) |
| ***A61H 33/00*** | (2006.01) |
| ***A61H 33/02*** | (2006.01) |

(52) U.S. Cl.

CPC ..... *A47K 3/06* (2013.01); *A61H 33/0087* (2013.01); *A61H 33/02* (2013.01); *A61H 33/6005* (2013.01); *A61H 2201/0107* (2013.01)

(58) Field of Classification Search

CPC ..... A47K 3/02

USPC ..... 4/538–595

See application file for complete search history.

(56) References Cited

U.S. PATENT DOCUMENTS

| | | | | |
|---|---|---|---|---|
| 3,373,463 | A * | 3/1968 | Wells | E04F 19/02 24/297 |
| 5,745,934 | A * | 5/1998 | Hansen | A47K 3/02 4/541.1 |
| 6,327,722 | B1 * | 12/2001 | Noble | A47K 3/16 4/548 |
| 6,349,427 | B1 * | 2/2002 | Bergstrom | A47K 3/00 4/541.1 |
| 7,802,324 | B2 * | 9/2010 | Layfield | A47K 3/00 4/541.1 |
| 8,296,873 | B2 * | 10/2012 | Dragovich | A61H 33/00 362/147 |
| 2004/0103472 | A1 * | 6/2004 | Marbach | E04H 4/0062 4/506 |
| 2007/0033728 | A1 * | 2/2007 | Sisk | A47K 3/1615 4/584 |
| 2009/0064633 | A1 * | 3/2009 | Matson | E04H 17/08 52/831 |
| 2009/0172873 | A1 * | 7/2009 | Ludlow | E04H 4/0062 4/506 |

(Continued)

*Primary Examiner* — Lori Baker

(74) *Attorney, Agent, or Firm* — Lapple Ubell IP Law, LLP; Franklin D. Ubell

(57) ABSTRACT

Spa side panels are trapezoidally-shaped and mounted in respective grooves defined by adjacent tapered corner pieces and their mounting brackets to accommodate differences in coefficients of expansion of the respective parts and prevent structural damage. Angled force transfer members are configured to mate with swept back side surfaces of a spa base pan to achieve a pedestal appearance, and the bottom surface of the base pan is constructed to reduce heat transfer to the spa support surface.

6 Claims, 22 Drawing Sheets

(56) References Cited

U.S. PATENT DOCUMENTS

| | | | | |
|---|---|---|---|---|
| 2009/0211011 | A1* | 8/2009 | Walker | E04H 4/0043 4/506 |
| 2009/0260150 | A1* | 10/2009 | Dragovich | A47K 3/161 4/584 |
| 2012/0124734 | A1* | 5/2012 | Lau | A61H 33/6005 4/506 |
| 2013/0152297 | A1* | 6/2013 | Ludlow | E04H 4/14 4/506 |

* cited by examiner

PORTABLE SPA CONSTRUCTION

CROSS REFERENCE TO RELATED APPLICATIONS

This application is a divisional of and claims the benefit of and priority to U.S. patent application Ser. No. 14/263,144 filed Apr. 28, 2014 entitled "Portable Spa Construction" which claims the benefit of and priority to U.S. Provisional Application Ser. No. 61/927,396, filed Jan. 14, 2014, of the same title, the contents of each of which is hereby incorporated by reference herein in its entirety.

BACKGROUND OF THE DISCLOSURE

Field of the Disclosure

The subject disclosure relates to spas, tubs, and the like and more particularly to an improved portable spa structure and the construction thereof.

Related Art

Portable spas have become quite popular as a result of their ease of use and multiplicity of features such as varied jet and seating configurations.

SUMMARY

The following is a summary of description of illustrative embodiments of a new spa structure, and more particularly a new portable spa structure. It is provided as a preface to assist those skilled in the art to more rapidly assimilate the detailed design discussion which ensues and is not intended in any way to limit the scope of the claims which are appended hereto in order to particularly point out the invention.

According to an illustrative embodiment, a spa structure is provided comprising a plurality of corner pieces, each positioned at a respective corner of the structure and a plurality of trapezoidal shaped side panels positioned between the corner pieces. Each side panel is positioned with its respective side edges located in grooves defined by the corner pieces and their mounting brackets such that each side panel may move or slide both horizontally and vertically with respect to the corner pieces and other structural parts so as to accommodate expansion or contraction of the side panels. In this configuration, a lower edge of each side panel is held in place by a plurality of panel clips, each of which is pivotable into and out of a panel retaining position, which facilitates panel installation and disassembly.

Such an illustrative structure may further include a generally rectangular base pan of smaller width and length than a generally rectangular outer upper rim of the spa, with the base pan being centrally positioned within and beneath the outer upper rim and including a plurality of downwardly and inwardly swept back lower side surfaces extending from the lower edges of the side panels to lower edges of the base pan. A plurality of vertical support members are configured to support an upper rim of a spa shell, and a plurality of angled force transfer members are attached at respective lower ends of the vertical support members to transfer force from each respective vertical support member to an inner bottom surface of the base pan.

DETAILED DESCRIPTION

Figure 1:
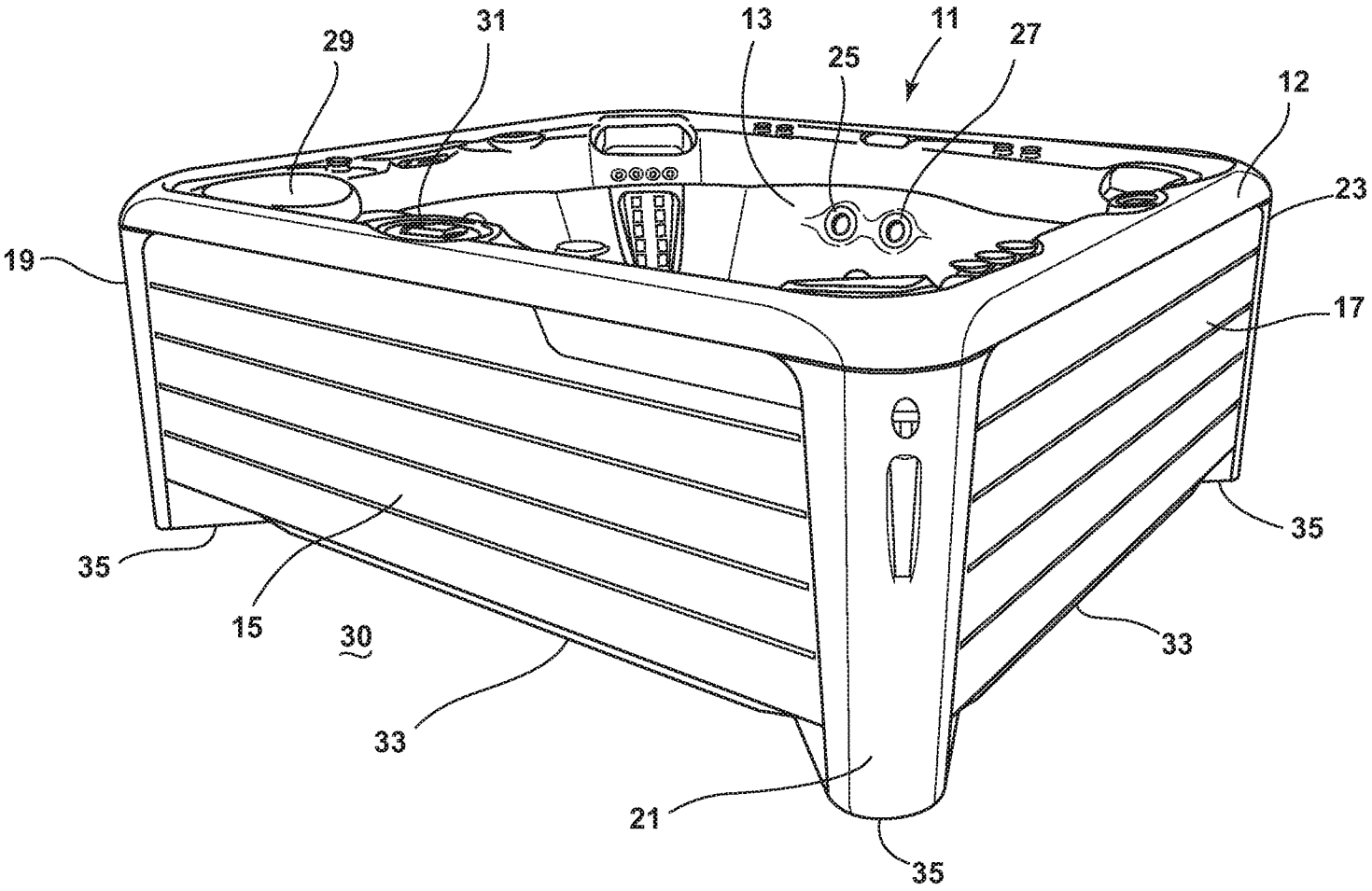
FIG. 1 is a perspective view of a portable spa according to an illustrative embodiment.
Figure 30:
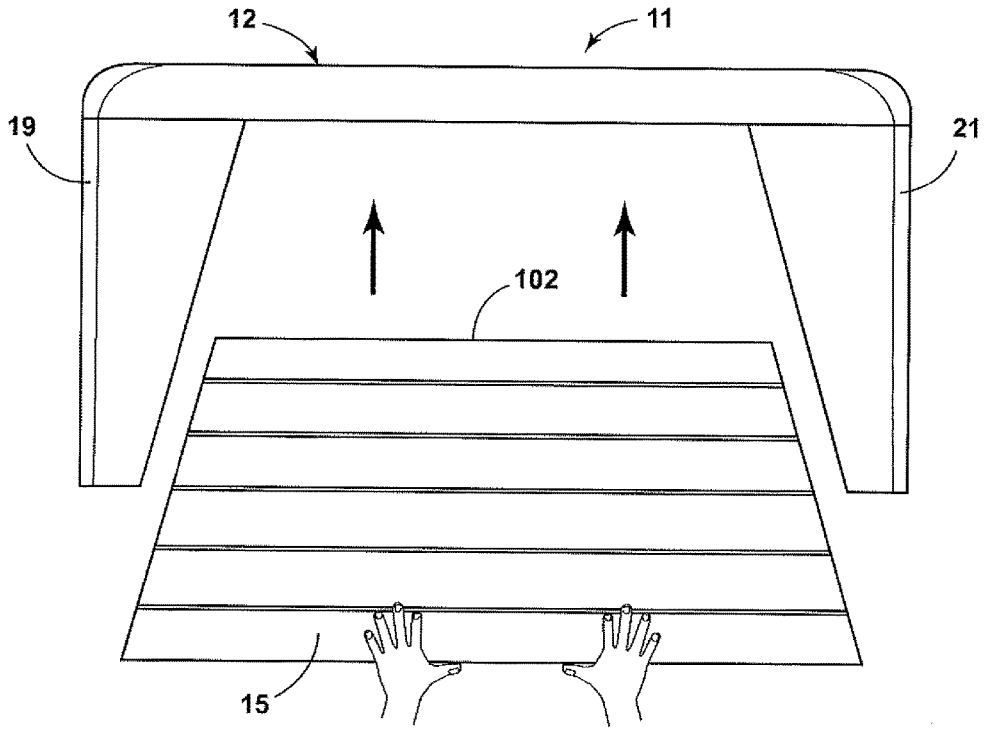
FIG. 30 is a front schematic view illustrating installation of a side panel according to an illustrative embodiment.
Figure 31:
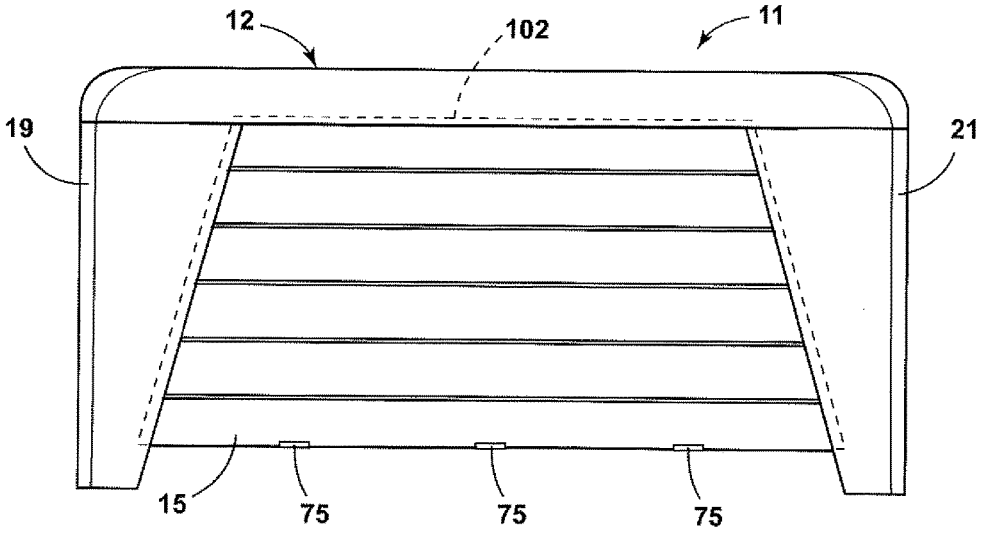
FIG. 31 is a front schematic view illustrating the side panel of FIG. 30 in the installed position.

FIG. 1 illustrates a portable spa 11 having a spa shell 13, side panels, e.g., 15, 17 and tapered corner fascia pieces, e.g., 19, 21, 23. The spa shell 13 has a generally rectangular rim 12 about its upper periphery and includes various features such as jets, e.g. 25, 27, a filter compartment 29 and a remote control 31. As may be seen, the lower edges 33 of the side panels 15, 17 do not extend to the bottom edges 35 of the corner pieces 19, 21, 23 but rather terminate at a distance "d" (FIG. 2) above the slab, deck, ground or other surface 30 on which the spa rests, such distance "d" being, for example, 6 inches in one embodiment. In the illustrative embodiment, the corner pieces, e.g., 19, 21, 23, are slightly spaced above, and do not contact, the surface 30. Additionally, as shown in FIGS. 30 and 31, the side panels 15, 17 are trapezoidal in shape in one illustrative embodiment.

Figure 2:
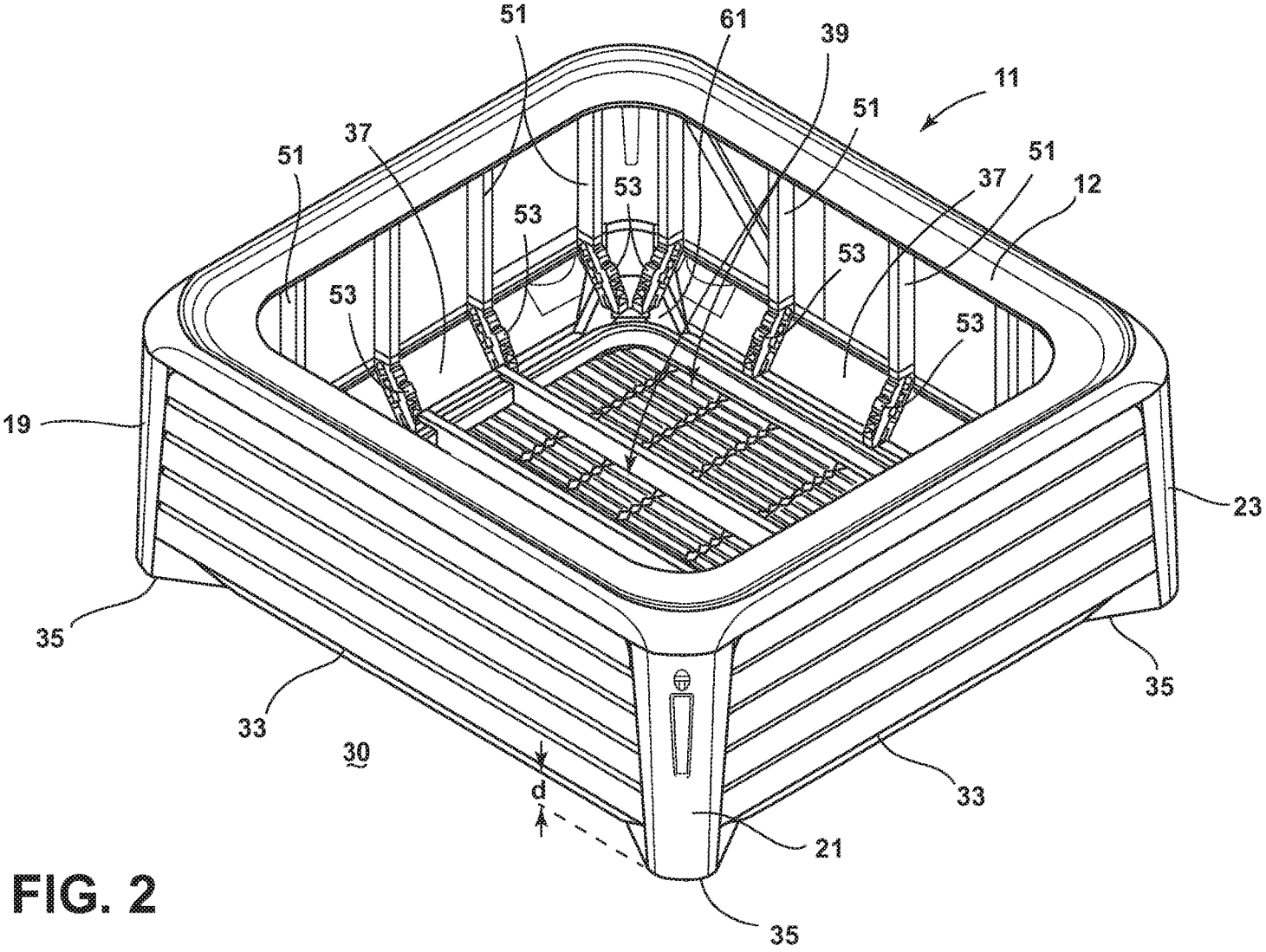
FIG. 2 is a perspective view illustrating the internal structure of the spa of FIG. 1.
Figure 4:
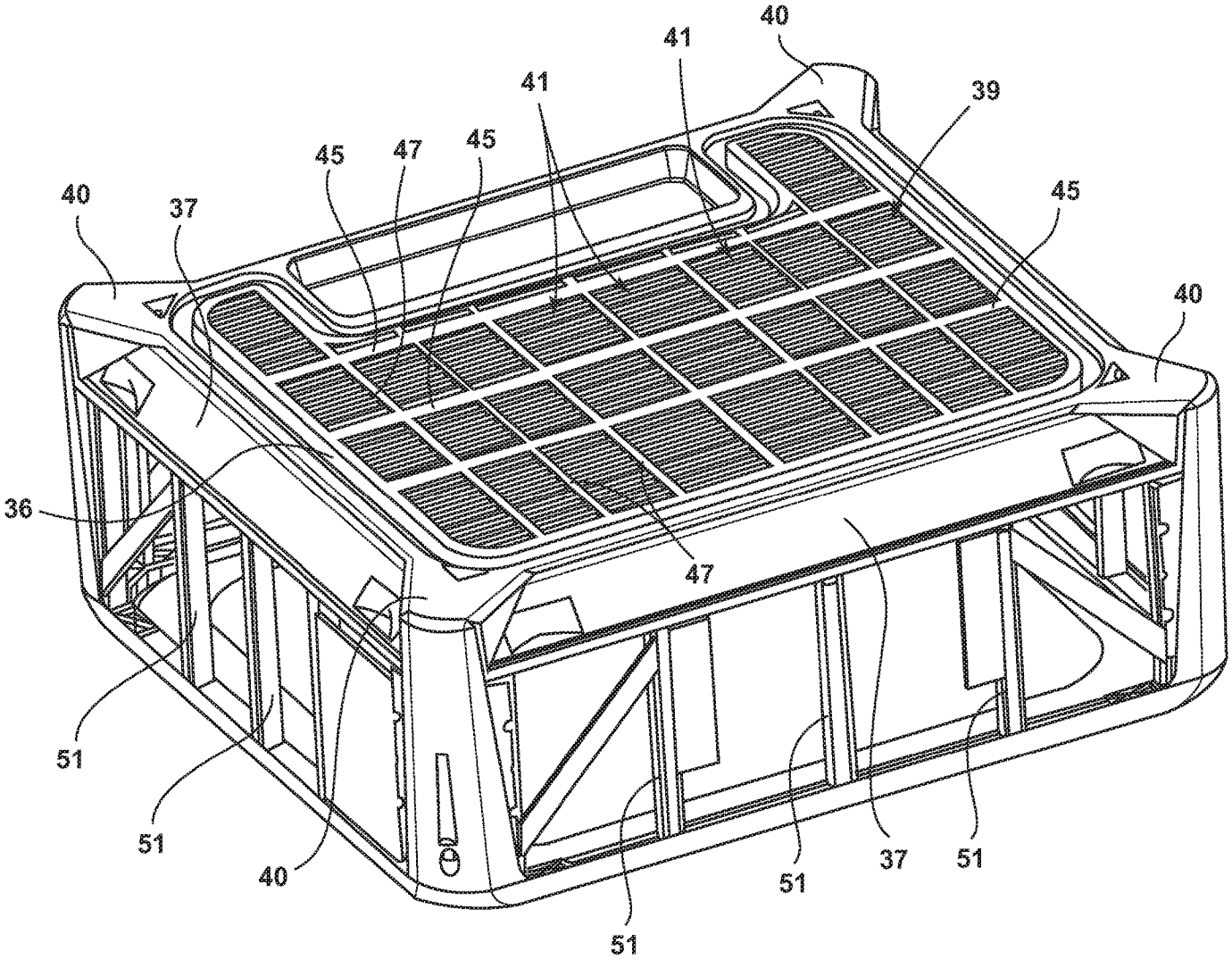
FIG. 4 is an inverted perspective view of the spa of FIG. 1 with side panels removed.
Figure 5:
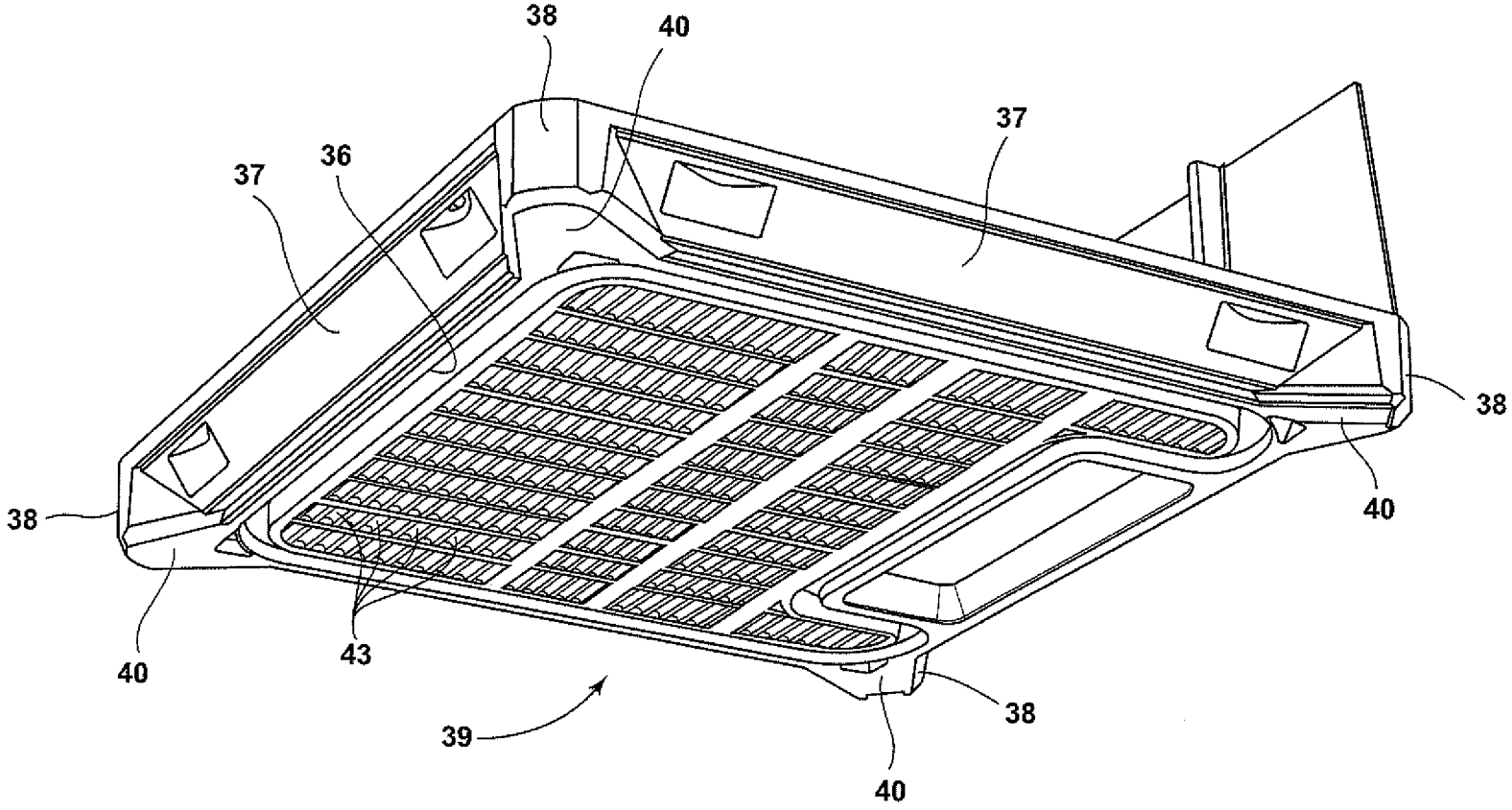
FIG. 5 is a perspective view illustrating a bottom pan component of the spa of FIG. 1.

The spa 11 further includes a base pan 39 shown in FIGS. 2, 4, and 5. As may be seen, the lower peripheral side surfaces 37 of the base pan 39 are recessed inwardly or swept back from the side panel edges 33 to provide a pedestal effect, giving the appearance that the spa 11 contacts the floor 36 only at its four corners and at the recessed edge 36 of the base pan 39. The spa base pan 39 itself has four corners 40, each of which lies within and is concealed by a respective corner fascia piece, e.g. 19, 21, 23. As seen in FIG. 4, the bottom of the base pan 39 further includes a grid work of rectangular areas 41 which include recessed fins or "thermal separators" , e.g. 43 (FIG. 5). The grid work is defined by perpendicularly disposed ribs 45, 47, whose flat bottom surfaces also rest on the surface 30. The rib and thermal separator structure on the bottom of the base pan 39 minimizes the surface area of the base pan 39 which is in contact with the surface 30 and, hence, reduces heat transfer from the spa 11 to the surface 30.

Figure 3:
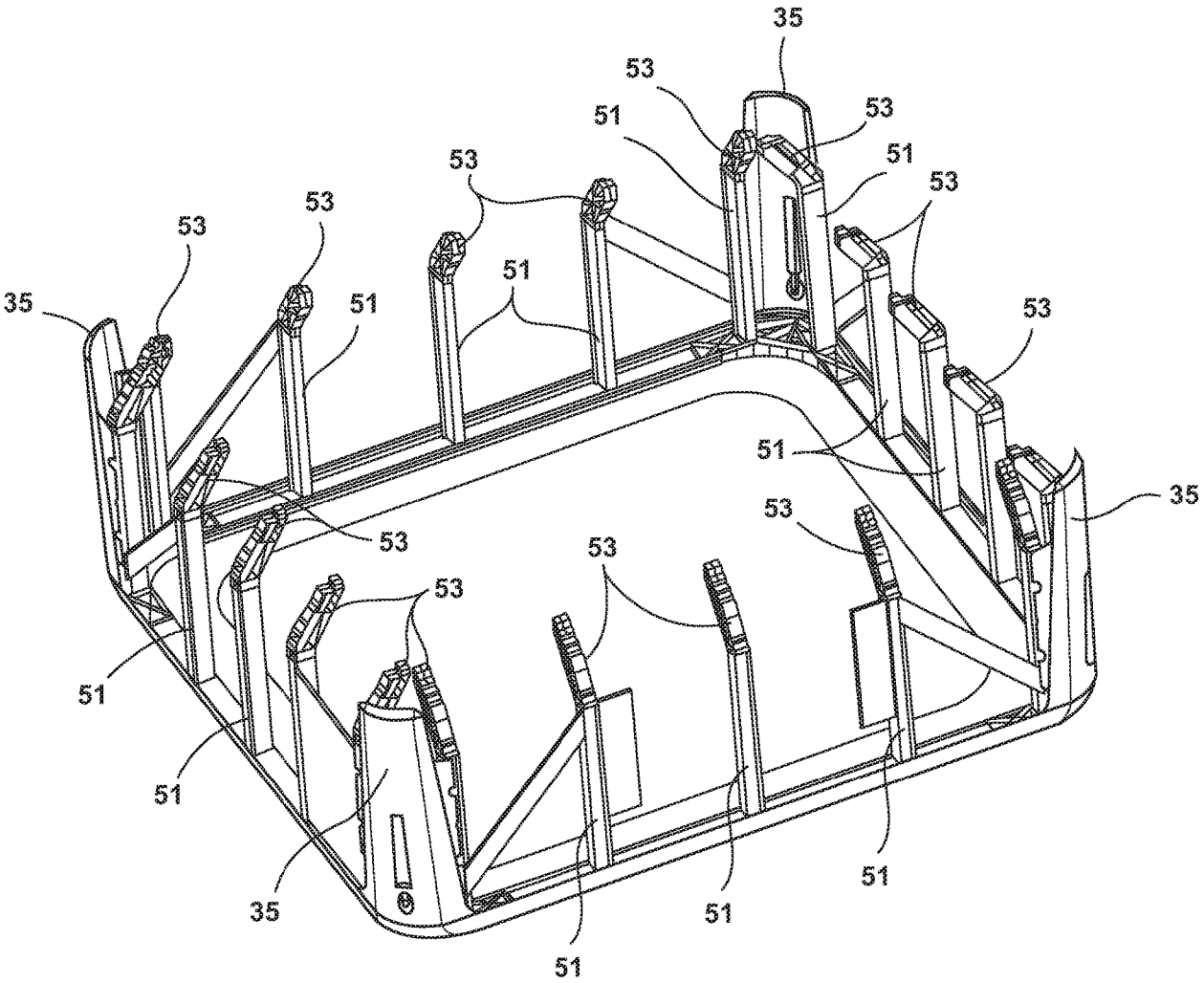
FIG. 3 is an inverted perspective view of illustrative frame structure of the spa of FIG. 1.
Figure 6:
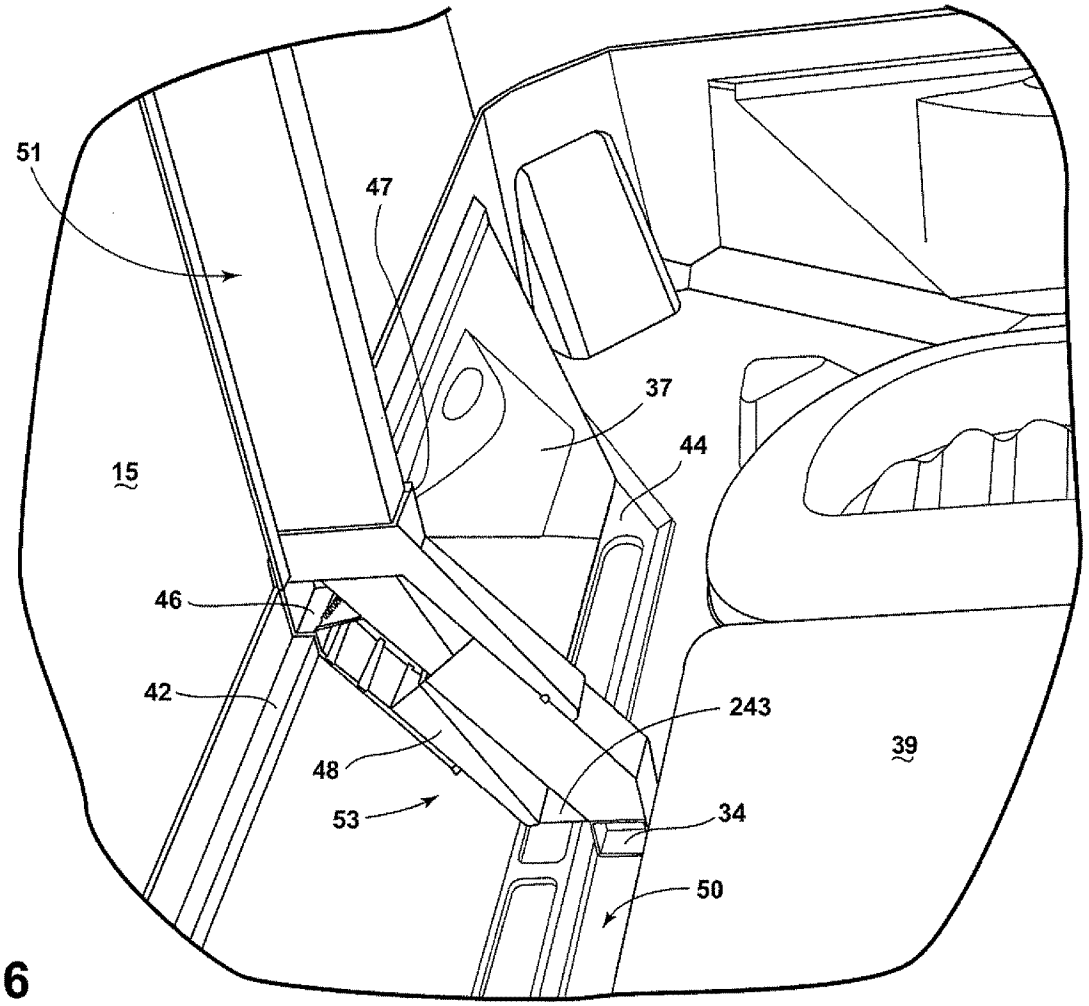
FIG. 6 is a perspective fragmentary view illustrating internal support members of the spa of FIG. 1 according to an illustrative embodiment.

As shown in FIGS. 2 and 3, in order to support the spa shell 13, vertical support members 51 are provided to which are attached angled force transfer members 53, for example, by gluing, snap-fitting, or other fastening mechanism. FIG. 6 particularly shows the inter-fitting relationship of the base pan side surface 37 and the force transfer members 53 according to an illustrative embodiment. As may be seen, the side surface 37 has an inner horizontally disposed top step 42 and a horizontally disposed lower step 44. The angled force transfer member 53 includes a stepped edge 46 shaped to mate with the top step 42. The stepped edge 46 forms into an angled surface 48, which rests on the swept back surface 37. The angled surface 48 continues into a second step 243, which mates with the lower step 44. A slot or channel 50 is further formed in the base pan 39 and snugly receives a foot portion 34 of the angled force transfer member 53. Mating surfaces of the base pan surface 37 and the force transfer member 53 may be glued, snap-fitted, or otherwise fastened together in position in various embodiments.

In one embodiment, the vertical support member 51 and the angled force transfer member 53 may be fabricated of extruded ABS plastic and injection molded ABS plastic, respectively. The base pan 39 may be a thermoformed ABS plastic sheet. Other materials and fabrication techniques may of course be used in other embodiments.

In one embodiment, the force transfer member 53 may be a two piece component comprising respective halves 131, 133, as shown in FIGS. 7 to 15. The halves 131, 133, are mated together utilizing two tabs 141, 143, formed on the first half 131 and two tabs 150, 151 formed on the second half 133. These tabs 141, 143; 150, 151 may be seen in FIGS. 11 and 10, respectively.

Figure 9:
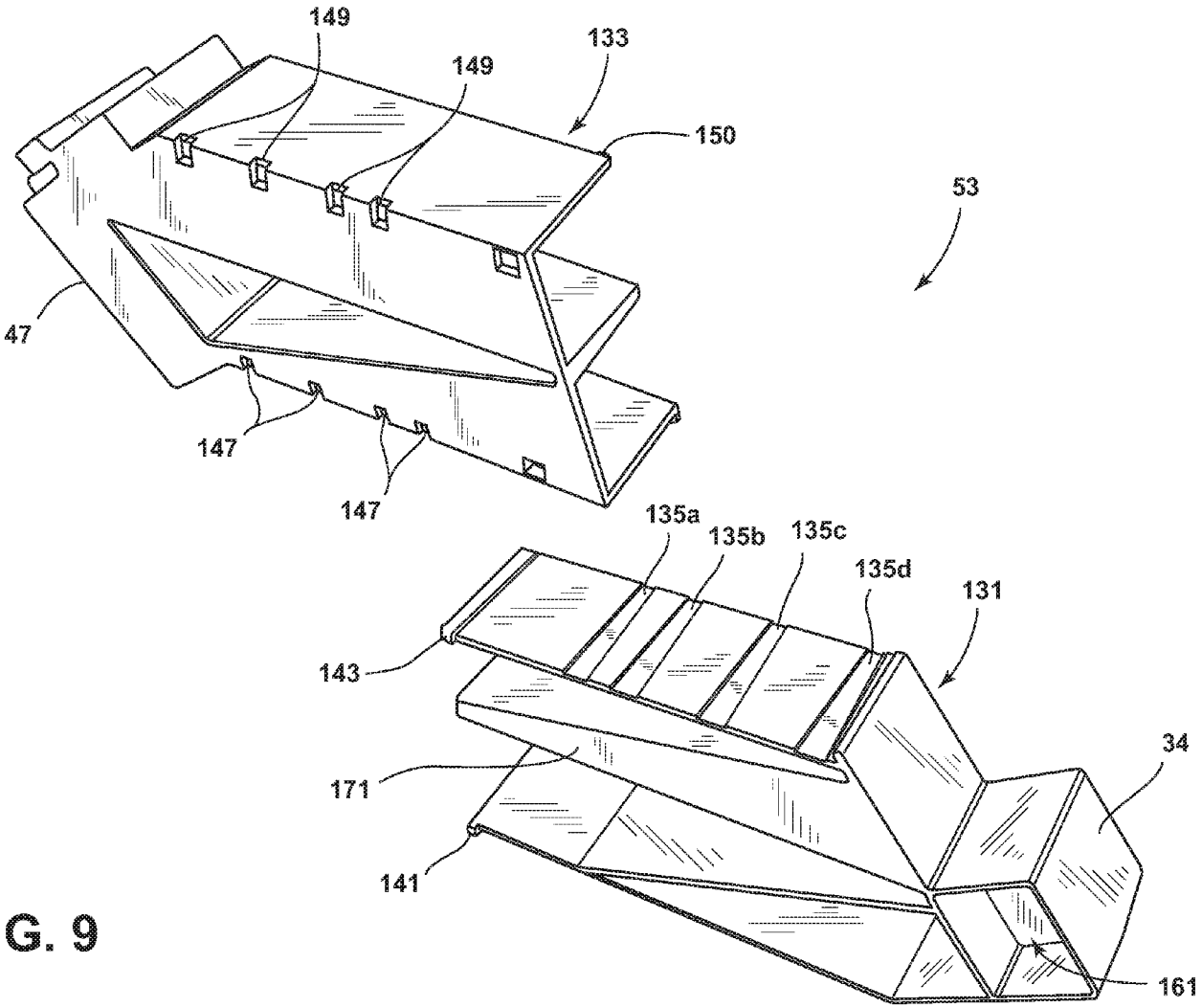
FIG. 9 is a side perspective view of respective halves of an angled force transfer member according to an illustrative embodiment.
Figure 10:
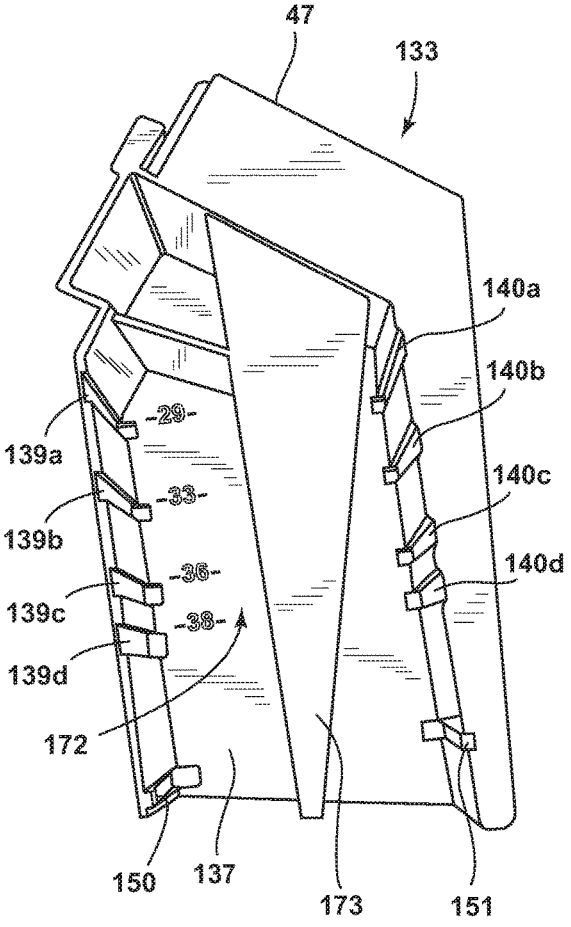
FIG. 10 is a side view illustrating internal structure of a first half of the illustrative angled force transfer member.

As further shown in FIG. 10, the interior 137 of the second half 133 of the force transfer member 53 may have height markers, e.g. "29", "33", "36", "38" molded or formed therein or applied thereto and located adjacent respective slots 139*a*, 139*b*, 139*c*, and 139*d* to indicate the particular spa rim height which can be accommodated by utilizing a particular slot. In operation, the two tabs 150, 151 on half 133 (e.g. FIG. 10) slide into one of the four groove pairs 135*a*, 134*a*; 135*b*, 134*b*; 135*c*, 134*c*; 135*d*, 134*d*, of the respective outer side surfaces of the first half 131 to select a particular height, while the tabs 141, 143 enter into a pair of holes or apertures 147, 149 (FIG. 9) of the second half 133. Thus, the first half 131 of the force transfer member 53 can be telescoped between positions -38-, -36-, -33-, -28- to increase or decrease the length of the angled force transfer member 53 and can be locked in position by the tabs 150, 151, as further described below.

Figure 7:
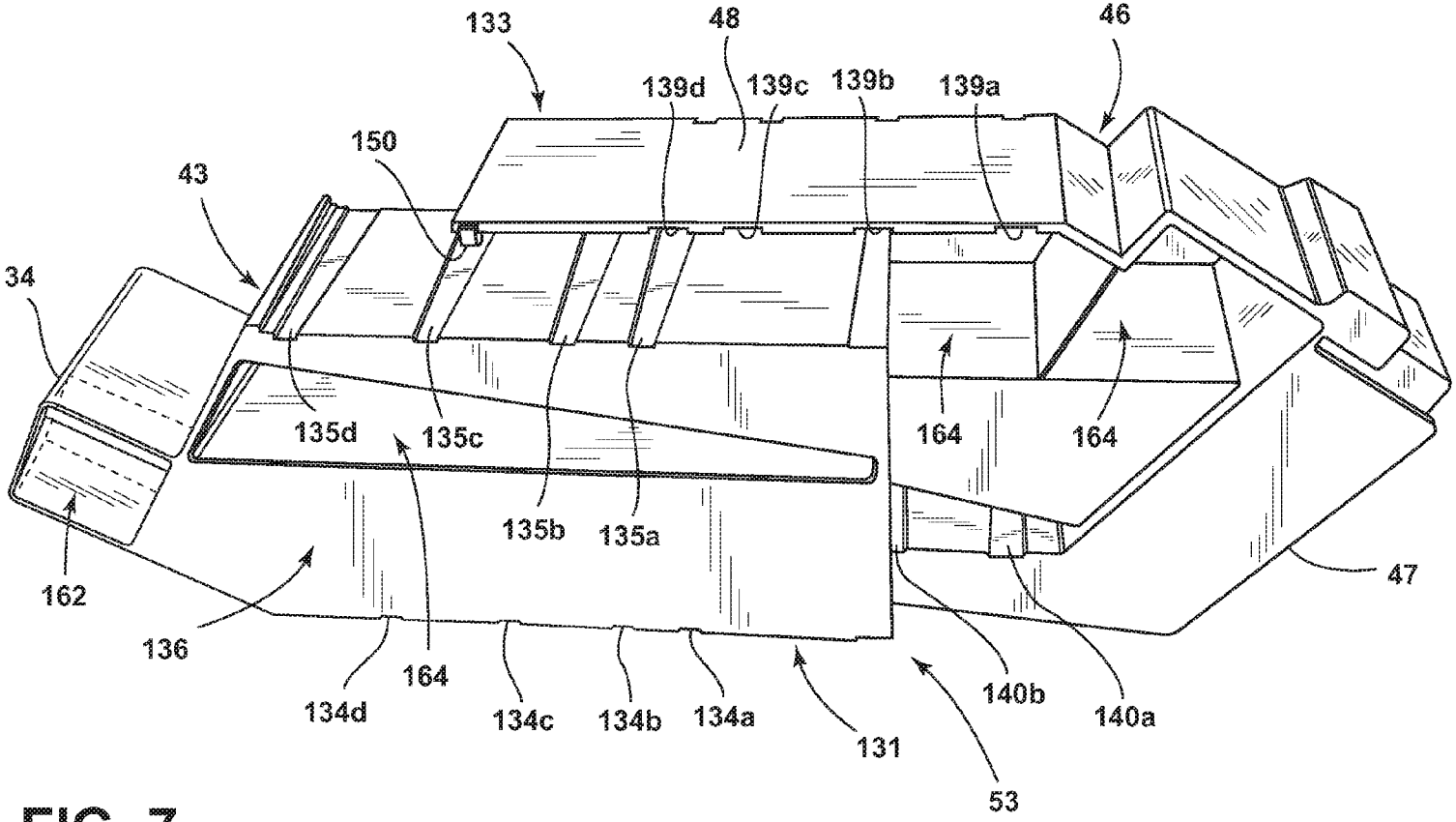
FIG. 7 is a perspective view illustrating assembly of angled force transfer member components according to an illustrative embodiment.
Figure 12:
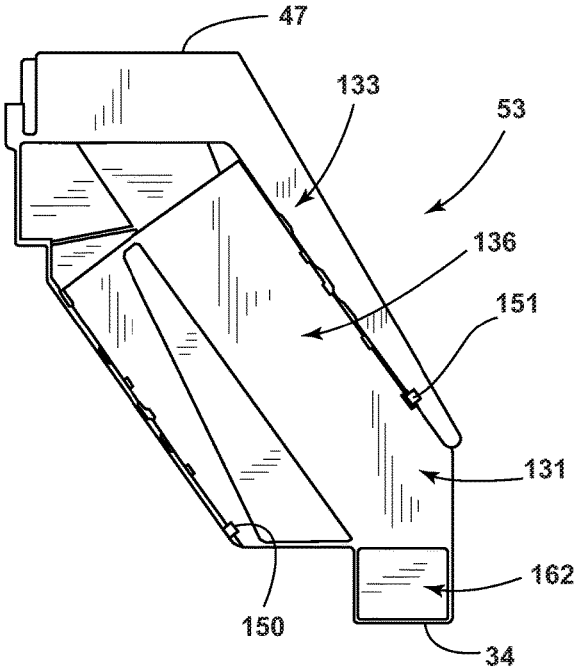
FIG. 12 is a first side view of the assembled angled force transfer member.
Figure 13:
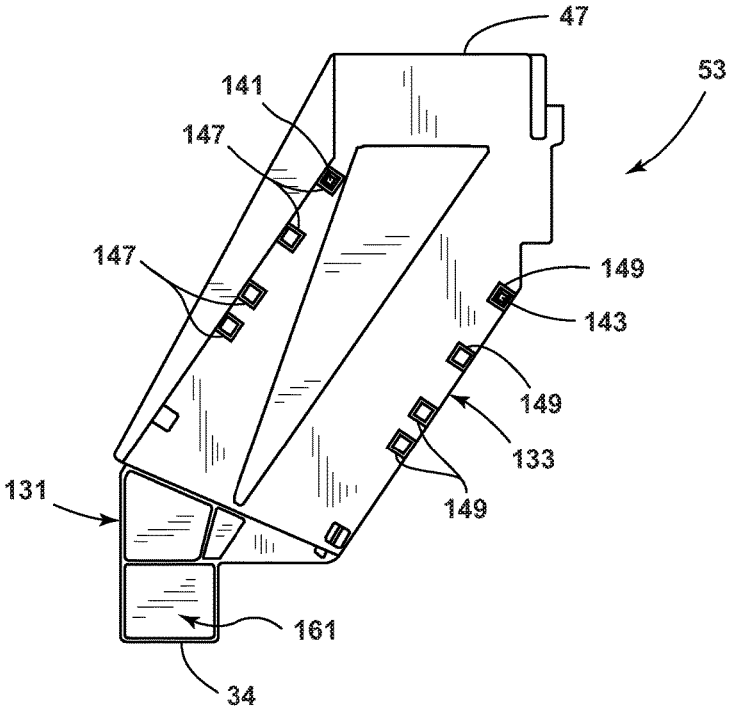
FIG. 13 is a second side view of the assembled angled force transfer member.
Figure 14:
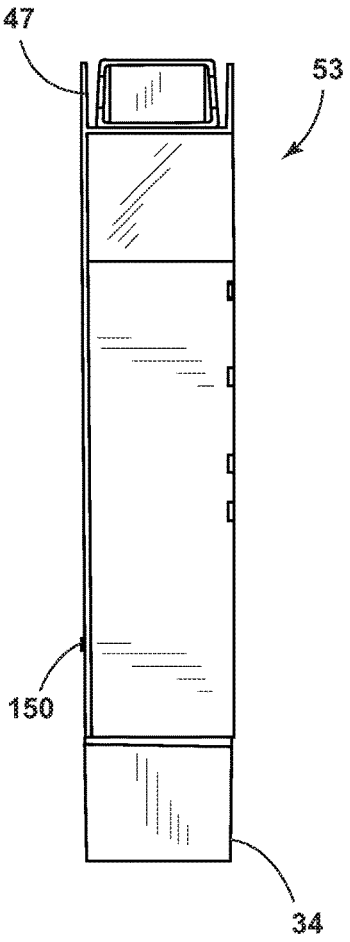
FIG. 14 is a front view of the assembled angled force transfer member.
Figure 15:
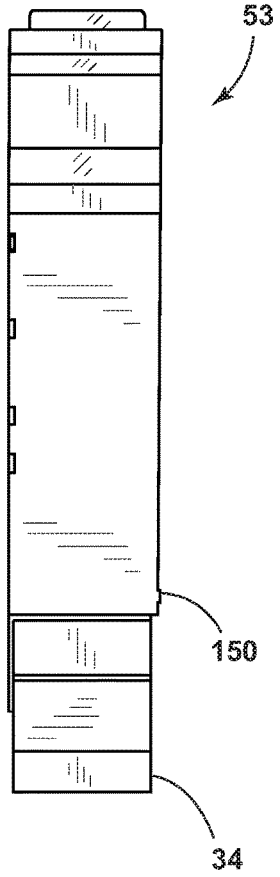
FIG. 15 is a back view of the assembled angled force transfer member.

The manner in which the first and second halves 131, 133 of the force transfer member 53 are attached together is further illustrated in FIG. 7. As may be seen, the tab 150 is riding in the second groove 135*c*. The tab 151 is also riding in a generally parallel groove 134*c* on the opposite side of the first half 131. At the same time, the tabs 141, 143 of the first half are passing through grooves 139*b*, 140*b* (FIG. 10) of the second half 133, thereby selecting the height of -33- inches. When the tabs 150, 151, reach the end of the respective grooves 135*c*, 134*c*, they snap down over the side surface 136 of the component 131, e.g., as shown in FIG. 12, to hold the respective halves 131, 133 together. At the same time, the tabs 141, 143 enter a pair of the slots 147, 149, as illustrated in FIG. 13, to further hold the assembly together. It may be noted that FIGS. 12 and 13 illustrate the -28- inch assembly position, whereas the assembly shown in FIG. 7 would result in tabs 150, 151 being positioned one groove up (135*c*, 134*c*) and the tabs 141, 143 being positioned one slot down from the positions shown in FIGS. 12 and 13.

Figure 11:
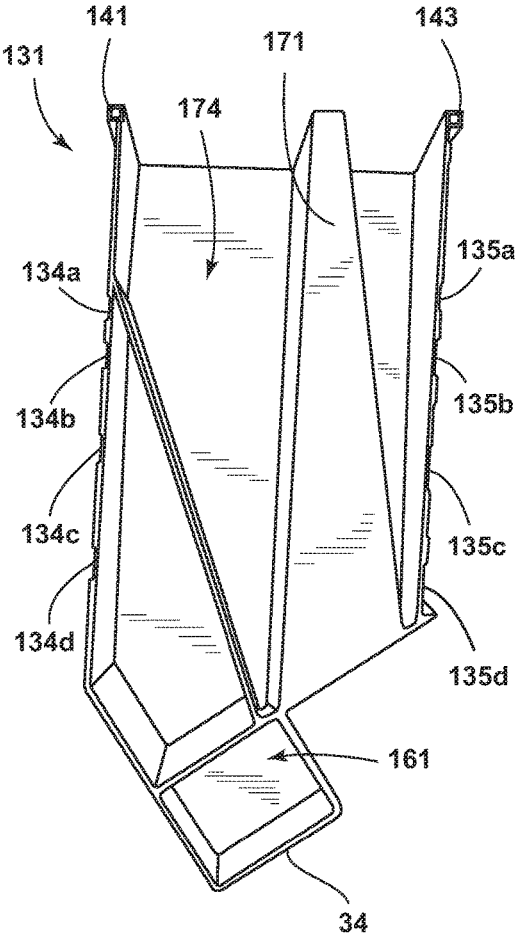
FIG. 11 is a side view illustrating internal structure of a second half of the illustrative angled force transfer member.

As shown in FIGS. 10 and 11, for example, the first half 131 has a tongue 171 and a cavity 174 formed in its interior, and the second half 133 has a cavity 172 and a tongue 173 formed in its interior. When the first and second halves 131, 133 are mated together, the tongue 171 on the interior of the first half 131 fits into the cavity 172 in the second half 133, while the tongue 173 of the second half 133 fits into the cavity 174 formed in the first half 131. The first half 131 further has an open or "cut-out" area 162 of rectangular cross-section formed therein (FIG. 7). In one embodiment, the area 162 has a shape identical to that of area 161 (FIG. 9). Additional open or hollow areas, e.g., 164 and area 165 (FIG. 8), are formed in the components 131, 133 to capture foam sprayed into the interior of the spa shell to thereby create a rigid foam/plastic structure.

Figure 8:
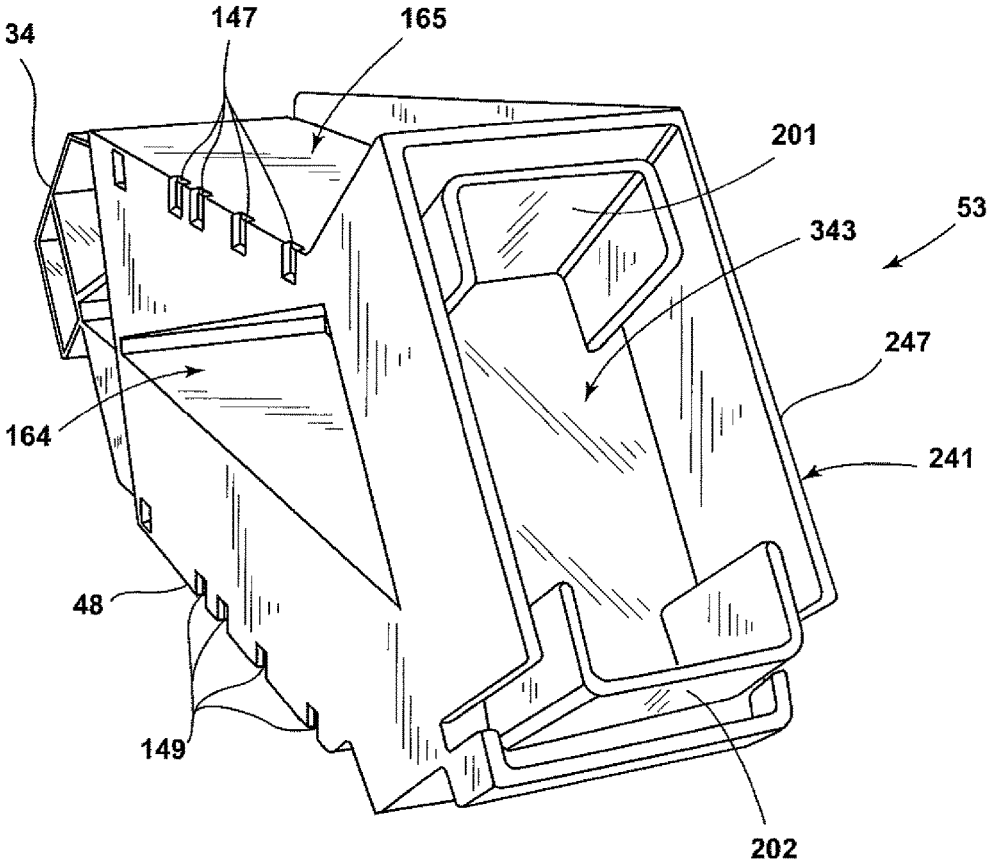
FIG. 8 is a top perspective view of an illustrative angled force transfer member.

As shown in FIG. 8, the illustrative force transfer member 53 has an upper receptacle 241 of generally rectangular cross-section formed as a part thereof having a rectangular rim 247 and a hollow interior 343. First and second u-shaped projections 201, 202 are formed in the hollow interior 343. In one embodiment, the lower end of a vertical support member 51 is configured to snugly mate or snap fit with the structure of the receptacle 241.

Figure 16:
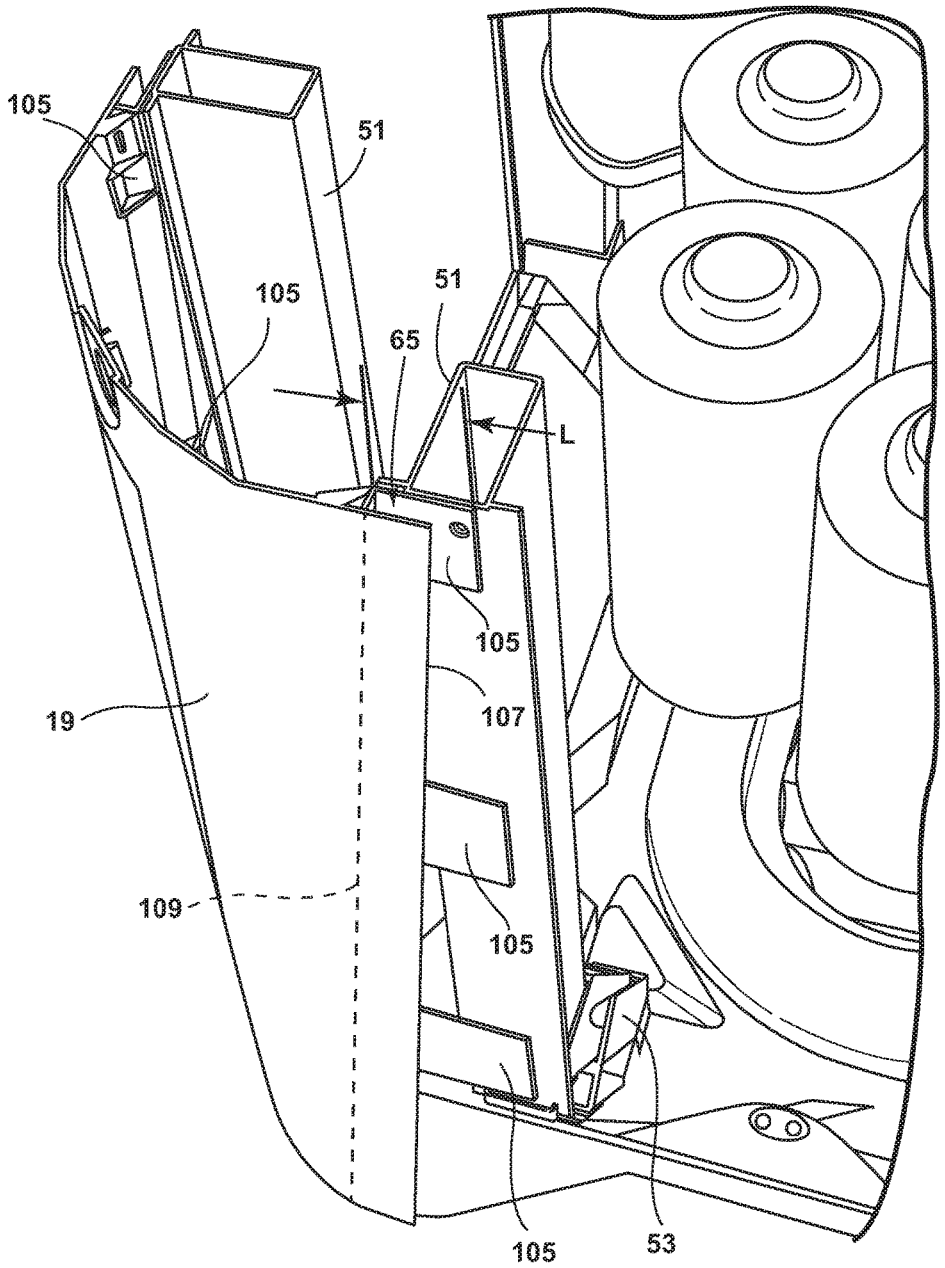
FIG. 16 is a fragmentary perspective view illustrating a corner portion of the spa of FIG. 1.
Figure 17:
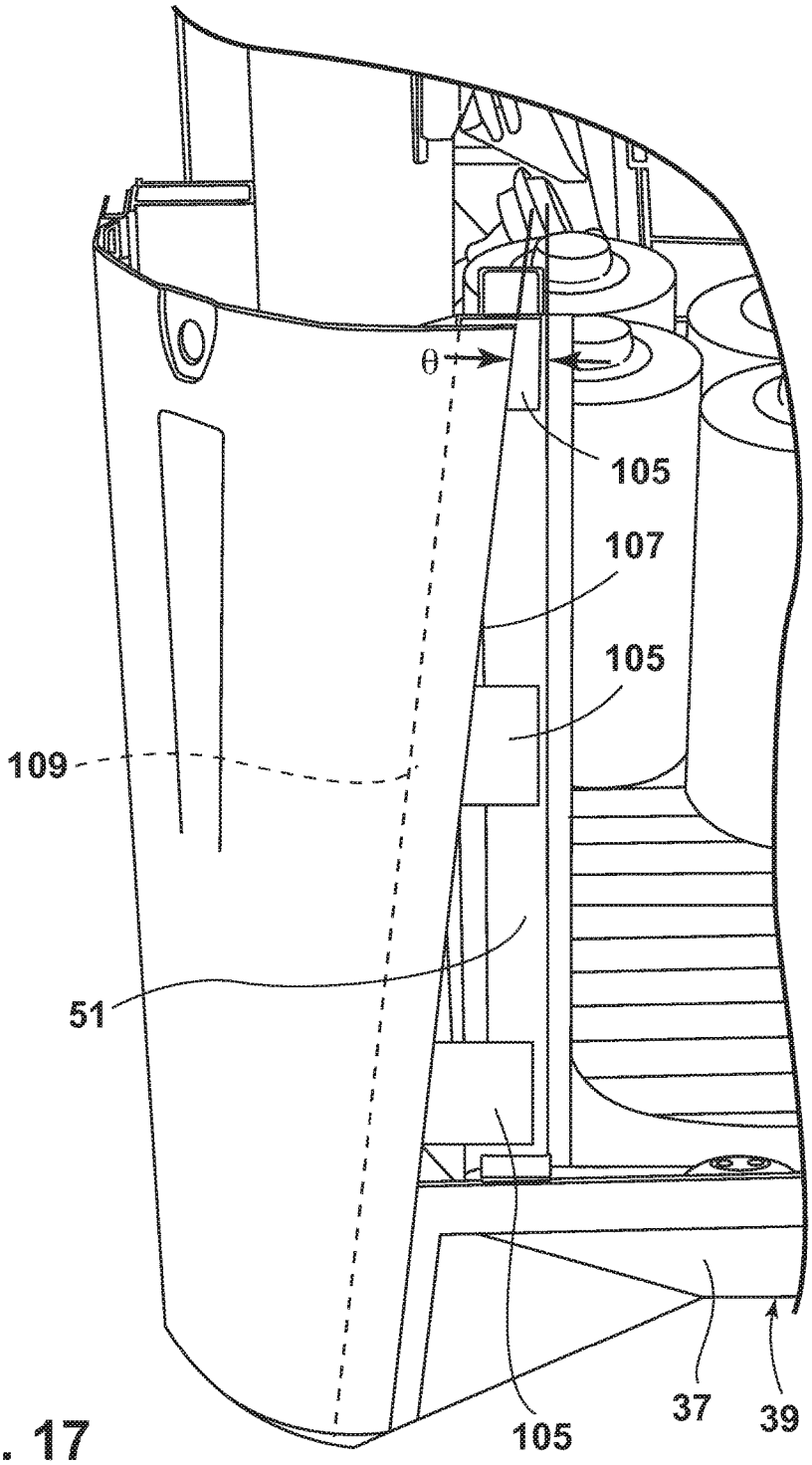
FIG. 17 is a fragmentary front view of the corner portion of FIG. 17.
Figure 18:
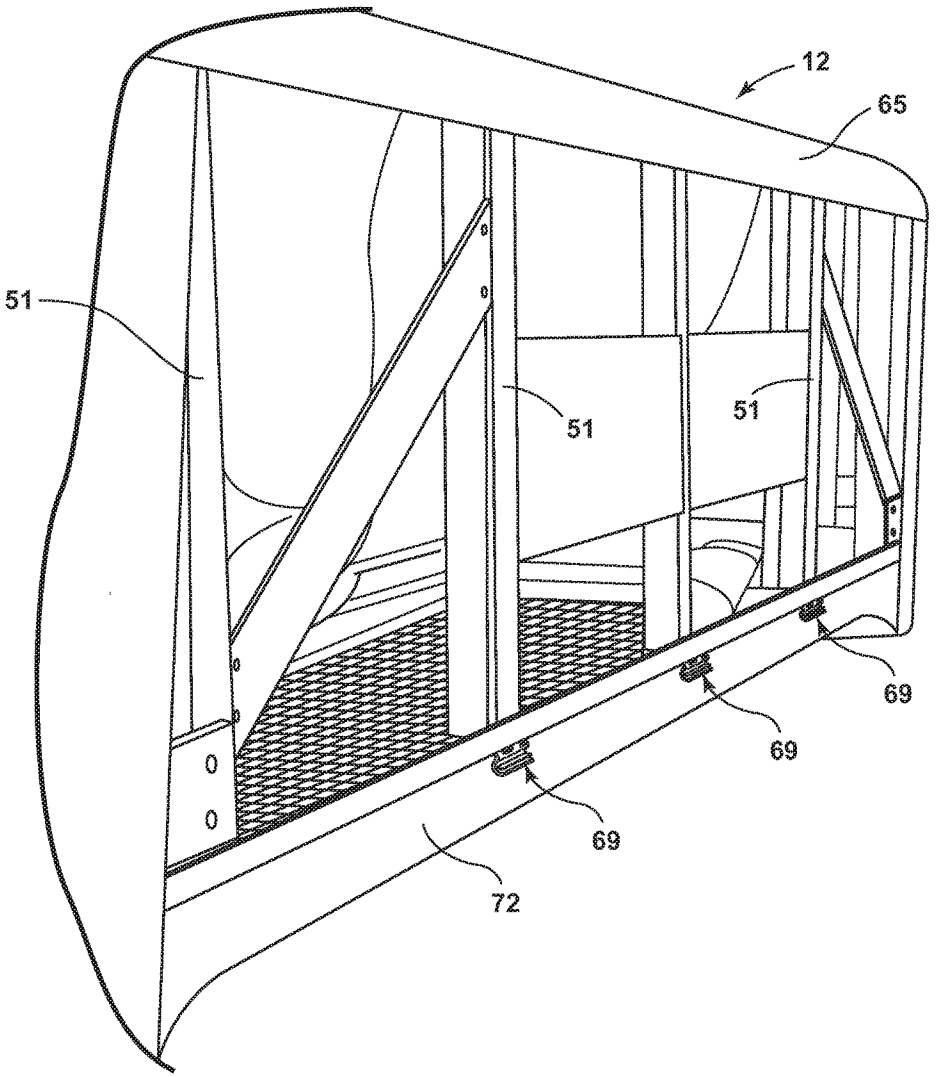
FIG. 18 is a fragmentary side perspective view of the spa of FIG. 1 with a side panel removed.

The illustrative embodiment is further constructed such that each side panel 15, 17, may be slid into position and retained in place without abutting or being attached to the corner pieces 19, 21, 23 or other spa structure. For this purpose, corner piece groove structures 65 are provided as shown in FIGS. 16 and 17, and three panel clips 69 are positioned along a lower surface 72 of the base pan 39, as shown in FIG. 18. While three panel clips 69 are shown in FIG. 18, the number of clips could be one, two, or more in various embodiments.

FIG. 16 illustrates attachment of one of the tapered corner pieces 19 to respective vertical support members 51 using a number of "U"-shaped brackets 105. A first leg of each bracket 105 attaches to the support member 51 and a second leg attaches to the corner piece 19. The length "L" of the first leg of each bracket 105 increases as the edge 107 of the corner piece 19 tapers away downwardly. In one embodiment, the angle θ (FIG. 17) between the corner piece's tapered edge 107 and the vertical is an acute angle, for example, such as six or seven degrees. The increasing bracket length effectively defines a gap or groove 65 between the brackets 105 and the corner piece 19 which lies along the dashed line 109, effectively paralleling the tapered outside edge 107. In the illustrative embodiment, the same type of groove 65 is formed by U-shaped brackets 105 associated with each of the other three corner pieces, e.g., 21, 23.

Figure 21:
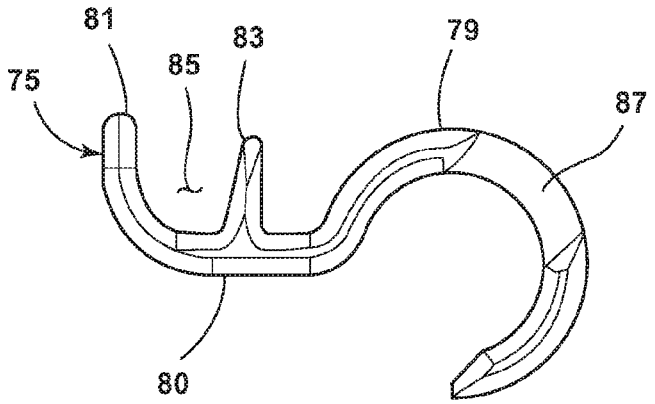
FIG. 21 is a side view of a latch component of the panel clip of FIG. 19.
Figure 22:
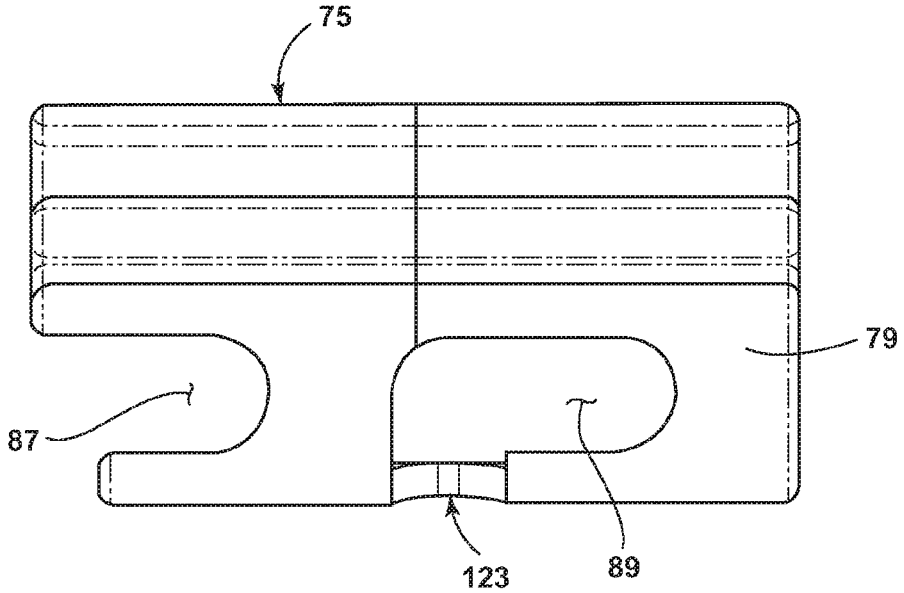
FIG. 22 is a front view of a latch component of FIG. 21.

The structure and operation of the panel clips 69 is further illustrated in FIGS. 19-27. Each panel clip 69 includes a pivot component 73 (FIGS. 23, 24) and a latch component 75 (FIGS. 21, 22). The latch component 75 has a hook-shaped back 79, which is unitarily formed with a front portion 80 having first and second lips 81, 83, whose inner surfaces define a channel 85. The hook-shaped back 79 includes a slot 87 and an elongated opening 89.

Figure 23:
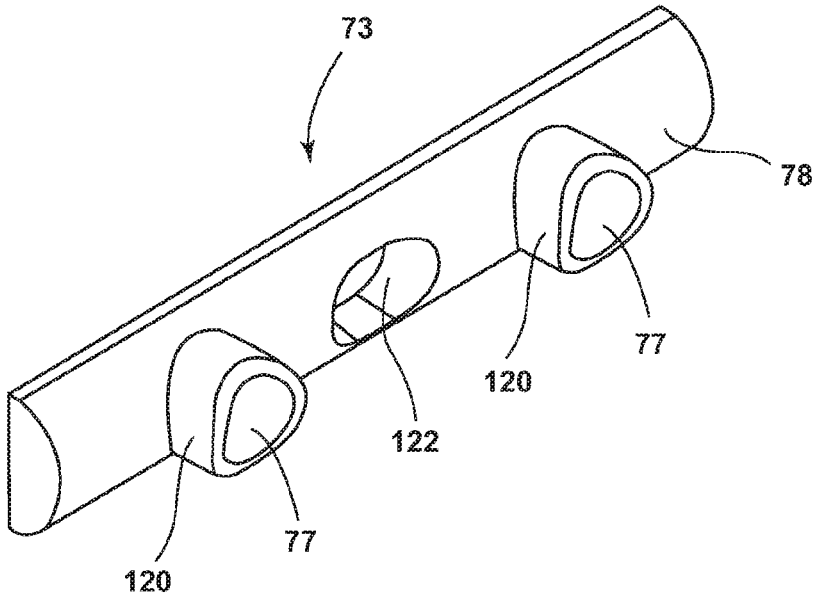
FIG. 23 is a rear perspective view of a pivot component of the panel clip of FIG. 19.
Figure 24:
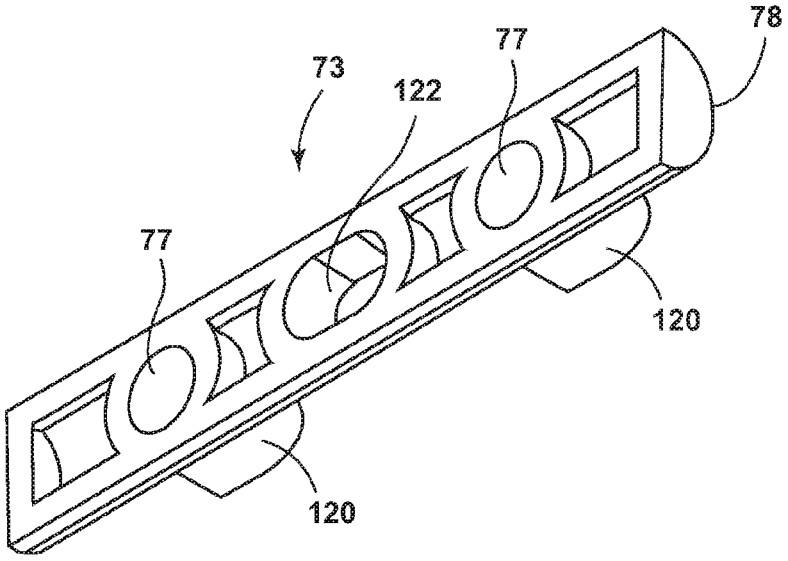
FIG. 24 is a front perspective view of the pivot component of FIG. 23.
Figure 28:
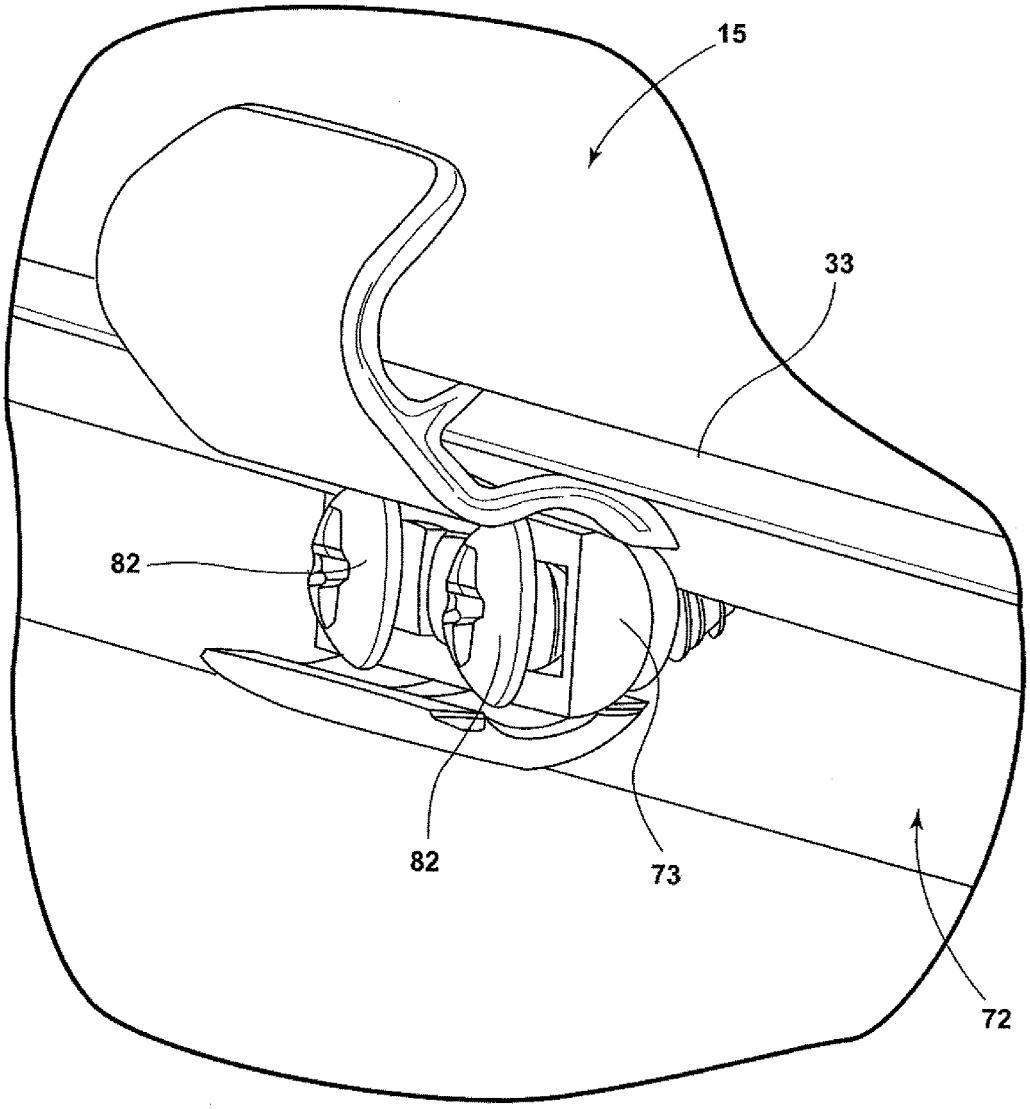
FIG. 28 is a fragmentary perspective view of the panel clip in a "closed" position.
Figure 29:
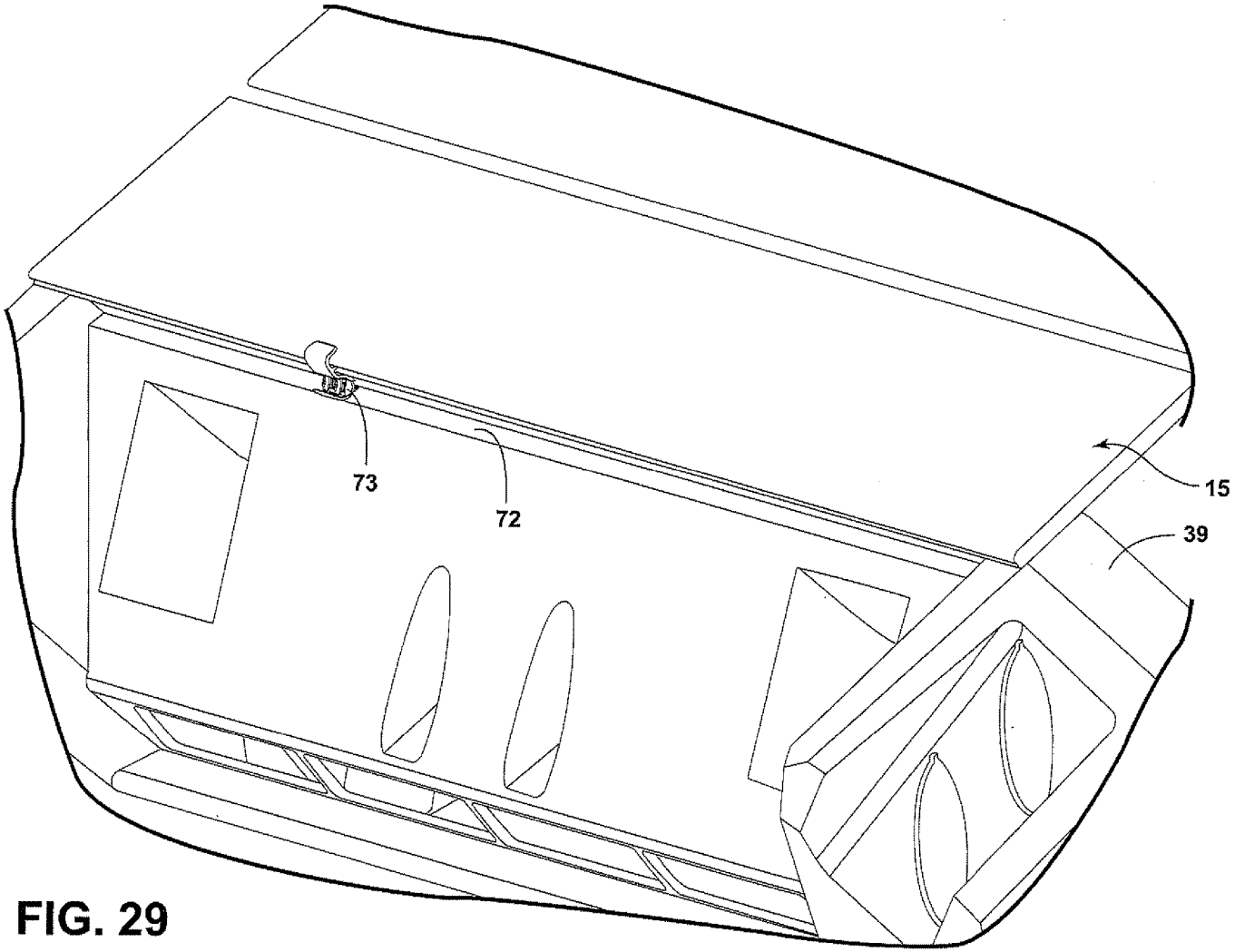
FIG. 29 is a second fragmentary view of the panel clip of FIG. 28.

As shown in FIGS. 23 and 24, the pivot component 73 has an arcuate back surface 78 from which project two bosses 120 through which are formed respective holes 77. As illustrated in FIGS. 28 and 29, respective screws or other fasteners 82 are inserted through the holes and into a side surface 72 of the molded base pan 39. The bosses 120 cause the arcuate back surface 78 to be spaced apart from the side surface 72 such that the latch component 75 can slide with respect to the pivot component 73. Thereafter, the latch component 75 may be pivoted from the open position shown in FIG. 19 to the locked position shown in FIGS. 20, 28, and 29 in which the channel 85 is oriented vertically so as to retain and prevent downward movement of the bottom edge of a panel 33 of a panel 15 while allowing the panel 15 to move laterally.

Figure 25:
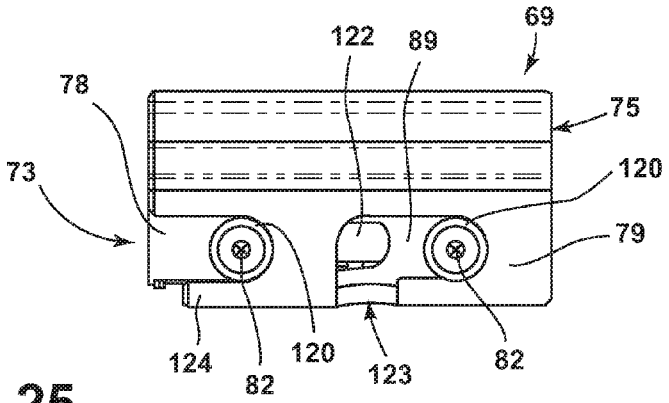
FIG. 25 is a rear view of the panel clip of FIG. 19.
Figure 26:
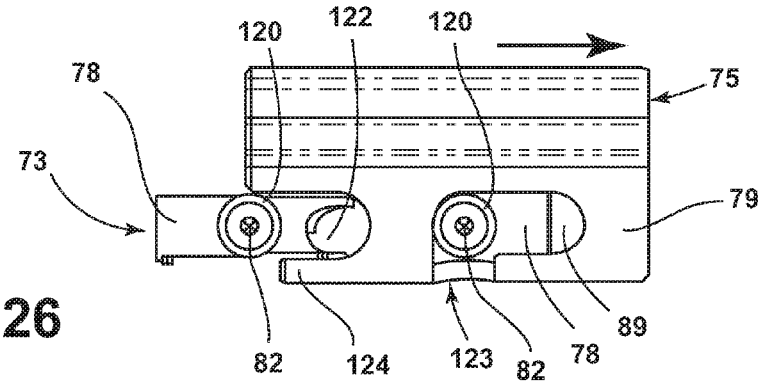
FIG. 26 is a rear view of the panel clip of FIG. 25 wherein the latch component has moved to the right in the Figure.
Figure 27:
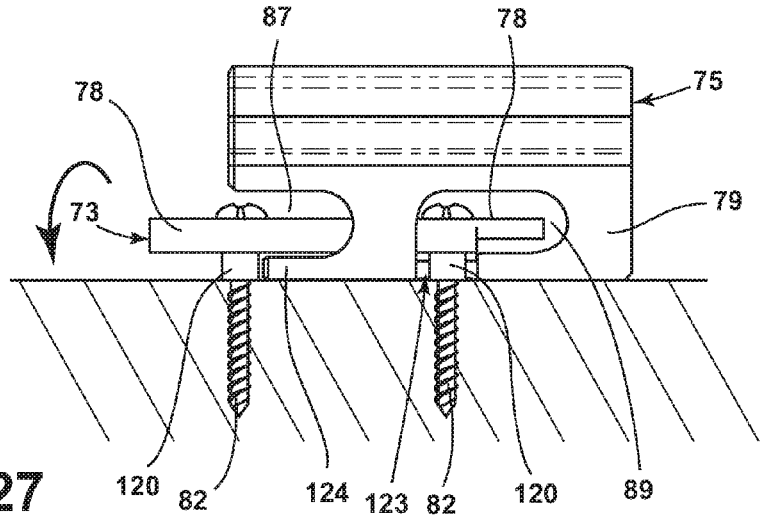
FIG. 27 is a top view of the panel clip of FIGS. 25 and 26 in the "open" position.

FIGS. 25-27 illustrate the operation of the panel clips 69 in more detail. FIG. 25 is a back view of the clip 69 in the locked position of, e.g., FIGS. 20 and 28. In this position, the right boss 120 of the pivot component 73 extends through the opening 89, and the left boss 120 extends through the slot 87. Hence, the latch component 75 cannot pivot due to the abutment of the bosses 120 with the respective adjacent surfaces of the opening 89 and the slot 87. In this position, in an illustrative embodiment, the screws 82 have further been tightened down to hold the components 73, 75 in the locked position.

FIG. 26 is also a back view of the clip 69, but in this case, the screws 82 have been unloosened slightly, and the latch component 75 has been moved to the right such that the left boss 120 has moved out of the slot 87, and the right boss 120 has moved into position over a cut-out area 123 formed in the latch component 75. In such position, the latch component 75 is free to pivot with respect to the pivot component 73.

Figure 19:
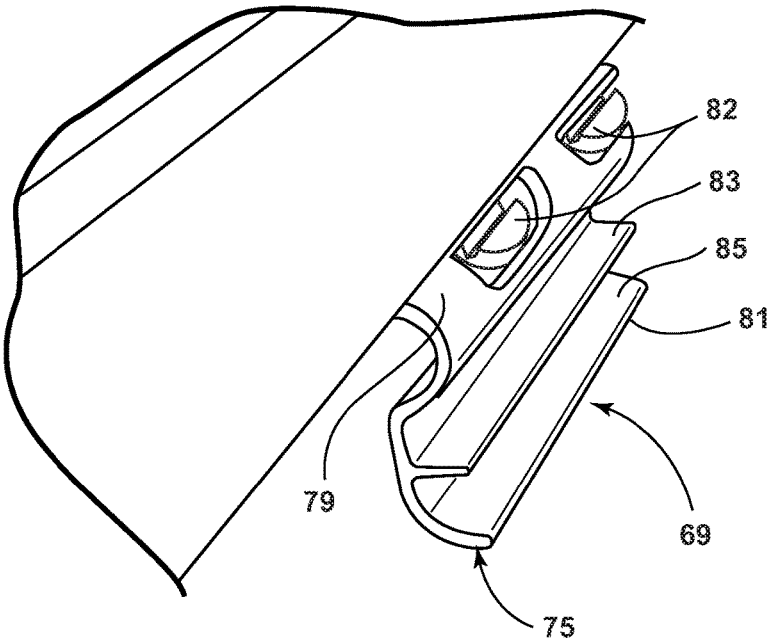
FIG. 19 is a perspective view of an illustrative embodiment of a panel clip in an "open" position.
Figure 20:
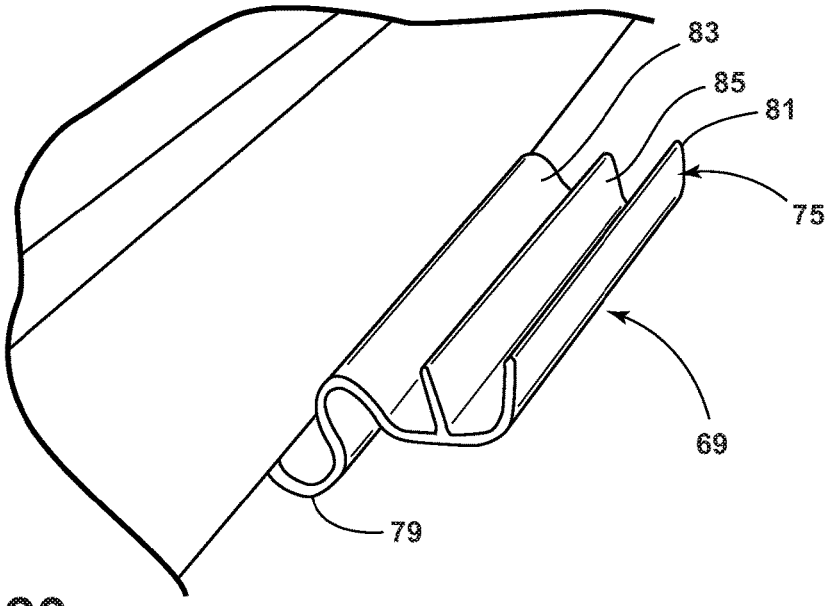
FIG. 20 is a perspective view of the panel clip of FIG. 19 in an "closed" position.

FIG. 27 is a top view of the clip 69 after the latch component 75 has been pivoted to the unlocked position of FIG. 19. In this position, the right boss 120 has pivoted into the cut out area 123 of the latch component 75, and the left boss 120 lies adjacent an outer leg 124 of the latch component 75.

The structure thus far described facilitates a side panel mounting method illustrated in FIGS. 30 and 31. As shown in FIG. 30, the spa 11 is positioned or raised off the mounting surface 30. A trapezoidal side panel 15 is then inserted upwardly such that its upper corners and its sides slide into the grooves 65 defined by brackets 105 and the corner pieces 19, 21. The panel 15 is then slid further upwardly until its top edge 102 passes behind the rim 12. At that point, the panel clips 69 are each moved into the locked position shown in FIGS. 20, 28, and 29 and the screws 82 are tightened to locking position.

The just-described side panel mounting method has the advantage that the side panels e.g. 15 are not rigidly attached to the corner pieces e.g. 19, 21, 23 or other structure, and therefore the panels e.g. 15 may expand and contract with temperature variations without the exertion of forces which would distort or otherwise damage the panels e.g. 15 if they were not free to expand or contract vertically or horizontally. This method has particular advantages in certain embodiments where the corner pieces, e.g., 19, are made of plastic and the side panels e.g. 15 are constructed of wood or of a plastic which has a coefficient of expansion which is different than that of the corner piece plastic. In such embodiments, the side panels e.g. 15 may expand or contract as much as half-inch in very hot or cold conditions, which would likely damage the spa structure, for example, by warping or cracking the panels 15.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. The spa structure comprising:

a base pan comprising a bottom surface having an outer perimeter; and a plurality of adjacent areas formed in said bottom surface, each area including a plurality of recessed fins, the plurality of areas of being arranged to reduce the surface area of the bottom surface which is in contact with a second surface upon which the bottom surface rests to thereby reduce heat transfer between the bottom surface and the second surface.

2. The spa structure of claim 1 wherein the base pan includes a plurality of swept back side surfaces, each configured to extend from a respective lower edge of a respective spa side panel to a lower edge of the base pan.

3. The spa structure of claim 1 wherein each of said plurality of adjacent areas is a rectangular shaped area.

4. The spa structure of claim 3 wherein each of said rectangular shaped areas is defined by a grid work comprising a plurality of perpendicularly disposed ribs.

5. The spa structure of claim 1 wherein a swept back side surface of the base pan has an inner horizontally disposed top step and a horizontally disposed lower step.

6. The spa structure of claim 2 wherein a swept back side surface of the base pan has an inner horizontally disposed top step and a horizontally disposed lower step.

* * * * *